US008806666B2

(12) United States Patent
D'Alessandro

(10) Patent No.: US 8,806,666 B2
(45) Date of Patent: Aug. 19, 2014

(54) NON-SLIP POCKETS

(76) Inventor: Brett D'Alessandro, Verona, NJ (US)

( * ) Notice: Subject to any disclaimer, the term of this patent is extended or adjusted under 35 U.S.C. 154(b) by 1034 days.

(21) Appl. No.: 12/643,536

(22) Filed: Dec. 21, 2009

(65) Prior Publication Data

US 2011/0145980 A1 Jun. 23, 2011

(51) Int. Cl.
*A41D 27/20* (2006.01)

(52) U.S. Cl.
CPC ..... *A41D 27/20* (2013.01); *A41D 2500/52* (2013.01); *A41D 2400/80* (2013.01)
USPC ..... 2/250

(58) Field of Classification Search
CPC ... A41D 27/20; A41D 27/201; A41D 27/202; A41D 27/205; A41D 27/207; A41D 27/208; A45F 5/0222
USPC ..... 2/247–254
See application file for complete search history.

(56) References Cited

U.S. PATENT DOCUMENTS

| | | | | | |
|---|---|---|---|---|---|
| 145,178 | A * | 12/1873 | Hopkins | 2/252 |
| 674,916 | A * | 5/1901 | Graham | 24/10 R |
| 1,355,044 | A * | 10/1920 | Hjelm | 2/252 |
| 1,767,967 | A * | 6/1930 | Davidoff | 2/248 |
| 2,295,425 | A * | 9/1942 | Potter | 2/247 |
| 2,436,879 | A * | 3/1948 | Buck | 2/248 |
| 2,544,840 | A * | 3/1951 | Kowatsch | 2/67 |
| 2,637,040 | A * | 5/1953 | Kay | 2/247 |
| 2,766,460 | A * | 10/1956 | Gerhart | 2/248 |
| 2,866,205 | A * | 12/1958 | Croxton | 2/247 |
| 3,723,994 | A | 4/1973 | Tucker | |
| 3,725,960 | A * | 4/1973 | Hall | 2/248 |
| 3,777,313 | A * | 12/1973 | Bergsten et al. | 2/247 |
| 4,716,600 | A * | 1/1988 | van Beek | 2/250 |
| 4,910,069 | A | 3/1990 | Isoe et al. | |
| 5,124,190 | A * | 6/1992 | Isoe et al. | 428/173 |
| 5,165,115 | A * | 11/1992 | Stanislaw | 2/247 |
| 5,255,392 | A * | 10/1993 | Stanislaw | 2/247 |
| 5,707,903 | A | 1/1998 | Schottenfeld | |
| 6,189,153 | B1 * | 2/2001 | Diamond | 2/247 |
| 6,760,926 | B1 * | 7/2004 | Miller | 2/250 |
| 8,272,507 | B1 * | 9/2012 | Crump et al. | 206/223 |
| 2002/0063069 | A1 | 5/2002 | Bouchard | |
| 2005/0262665 | A1 | 12/2005 | Hermann | |
| 2013/0139299 | A1 * | 6/2013 | Crump et al. | 2/247 |

* cited by examiner

*Primary Examiner* — Danny Worrell
(74) *Attorney, Agent, or Firm* — Michael J. Feigin, Esq.; Feigin & Associates, LLC

(57) ABSTRACT

The technology disclosed is a device and a method which allows one to temporarily store an object on one's person or otherwise which is non-disruptive to a person's present habits. The device is a pocket which remains open at the top, but has an extra fabric lining with has a higher frictional resistance than the pocket liner or material used to construct the garment, in general.

20 Claims, 6 Drawing Sheets

NON-SLIP POCKETS

FIELD OF THE DISCLOSED TECHNOLOGY

The disclosed technology relates generally to pockets of clothing and more specifically to pockets with an additional high friction lining.

BACKGROUND OF THE DISCLOSED TECHNOLOGY

Virtually ever person in the western world, and in fact, people anywhere in the world, have worn a garment with a pocket. Such garments are provided with one or more little bags used to hold small items. Such a bag-like receptacle is typically either fastened to, or inserted in, an article of clothing. In European clothing, pockets had their origin in purses hung from a belt, which could be concealed beneath a coat and reached by way of a slit in the outer garment. Any sack of a small size, e.g., about the size of an outstretched human hand or smaller, may be referred to as a pocket. Today, however, they are most commonly found sewn into, or forming an integral part of, our garments.

The pocket concept has caught on tremendously, with the possible exception of women's formal wear, such that most people in the western world wouldn't even consider buying an outfit without pockets. Still, there are drawbacks to pockets. For instance a person may lose an item left in his/her pocket. This may occur, typically, in one of to ways. First, the pocket may develop a hole and an item stored in the pocket may drop out through such a hole. Second, because the upper portion of the pocket is typically open, items placed in it may fall out from there.

Expounding further on the second situation, the pocket being open at the top, this is typically not a problem when the garment wearer is in a standing position. Gravity ensures that items in the pocket do not fall out of an upper opening. However, especially in the case of men's swim wear and lounge wear, the fabrics used are typically much smoother, the pockets less tight against the body of a wearer, and the positions of the pocket less upright. Such clothes are typically worn while lounging on a couch, sitting in a car or elsewhere, or lying down. It is common to find, after exiting from a taxi, or after getting up from a beach chair, or alighting from an amusement park ride that cellular phone or keys are no longer in their pocket.

Thus, there exists an unsolved need in the prior art to develop a device for storing items on one's person on a temporary basis which is more secure. Ideally, such a device should be non-disruptive to the general practices of people, as currently prevalent.

SUMMARY OF THE DISCLOSED TECHNOLOGY

It is an object of the disclosed technology to provide a device which allows one to temporarily store an object on one's person or otherwise which is non-disruptive to a person's present habits, but is more secure than that which is known in the art. As such, the device of the disclosed technology is a pocket which remains open at the top, but has an extra fabric lining with a higher frictional resistance than the pocket liner or material used to construct the garment, in general.

In an embodiment of the disclosed technology, a fabric pocket comprises two opposing fabric elements fixedly attached to each other at their peripheries and comprising an aperture there between at least a portion of a top side of the fabric elements. The aperture opens into an interior space of the pocket. An additional fabric liner is fixedly attached, within the interior space of the pocket, to at least a first fabric element. This additional fabric liner comprises a substantially higher frictional resistance than the fabric elements of the pocket. Substantially higher frictional resistance, for purposes of this specification, is defined as either such that it allows a typical pocket item (e.g., a watch, keys, phone or wallet) to remain within the pocket when the aperture is opening to the outside in a downward direction (e.g., −1 degree or further), when the pocket is being joggled. Alternatively, substantially higher friction resistance may be defined as having a coefficient of friction at least 20% higher than the fabric elements of the pocket.

A second additional fabric liner may be fixedly attached within the interior space of the pocket to a second fabric element. Further, part of an exterior region of the pocket may be fixedly attached to a garment, and the garment may have substantially the same frictional resistance as the fabric pocket. The additional fabric liner may be (made from) a synthetic fiber, a petroleum product (e.g., a plastic or synthetic rubber), and the garment itself or fabric elements of the pocket may be made from at least partially natural products (e.g., cotton, wool, etc.).

In a further embodiment of the disclosed technology, a fabric pocket comprises a first and second opposing fabric element fixedly attached to each other at their peripheries and comprising an aperture there between at least a portion of a top side of the fabric elements, the aperture opening into an interior space of the pocket. At least an interior side of the second opposing fabric element comprises a substantially higher frictional resistance than at least an interior side of the first fabric element. An exterior side of the second fabric element may comprise substantially identical frictional resistance (e.g., the same result of the 'slide test,' the test described above with reference to the previous embodiment, or alternatively, less than a 5% difference in frictional resistance) from that of the interior side of the first opposing fabric element. Additional sub-features comparable to the first embodiment, such as the materials used, are also claimed with reference to this embodiment.

A method of storing an object, in yet a further embodiment of the disclosed technology, is carried out by way of the steps of wearing a garment, the garment having a pocket wherein at least one side of an interior of the pocket has a substantially higher frictional resistance than an at least adjacent fabric of the garment, that is, adjacent to the pocket. Then, an object is placed in the interior of the pocket touching at least one side of the interior of the pocket (with higher frictional resistance), and releasing the object.

DETAILED DESCRIPTION OF EMBODIMENTS OF THE DISCLOSED TECHNOLOGY

A fabric pocket, as known in the art, comprises two opposing fabric elements fixedly attached to each other at their peripheries. An aperture there between the two opposing fabric elements, at, at least a portion of a top side of the fabric elements allows for ingress and egress of items to and from the pocket by way of an opening into an interior space of the pocket. In embodiments of the disclosed technology, an additional fabric liner/layer is fixedly attached, within the interior space of the pocket, to at least a first fabric element, and an additional fabric liner/layer may be attached to a second fabric element. That is, one side of the interior of a pocket or both sides (e.g., the entire interior) may be covered with this additional liner or layer. Such an additional liner or layer comprises a substantially higher frictional resistance than the fabric elements of the pocket. Substantially higher frictional resistance, for purposes of this specification, is defined as either such that it allows a typical pocket item (e.g., a watch, keys, phone or wallet) to remain within the pocket when the aperture is open to the outside in a downward direction (e.g., −1 degrees or further), when the pocket is being jostled or moved. Alternatively, substantially higher friction resistance may be defined as having a coefficient of friction at least 20% higher than the fabric elements of the pocket.

Embodiments of the disclosed technology will become clearer in light of the following description of the figures.

Figures 1A, 1B:
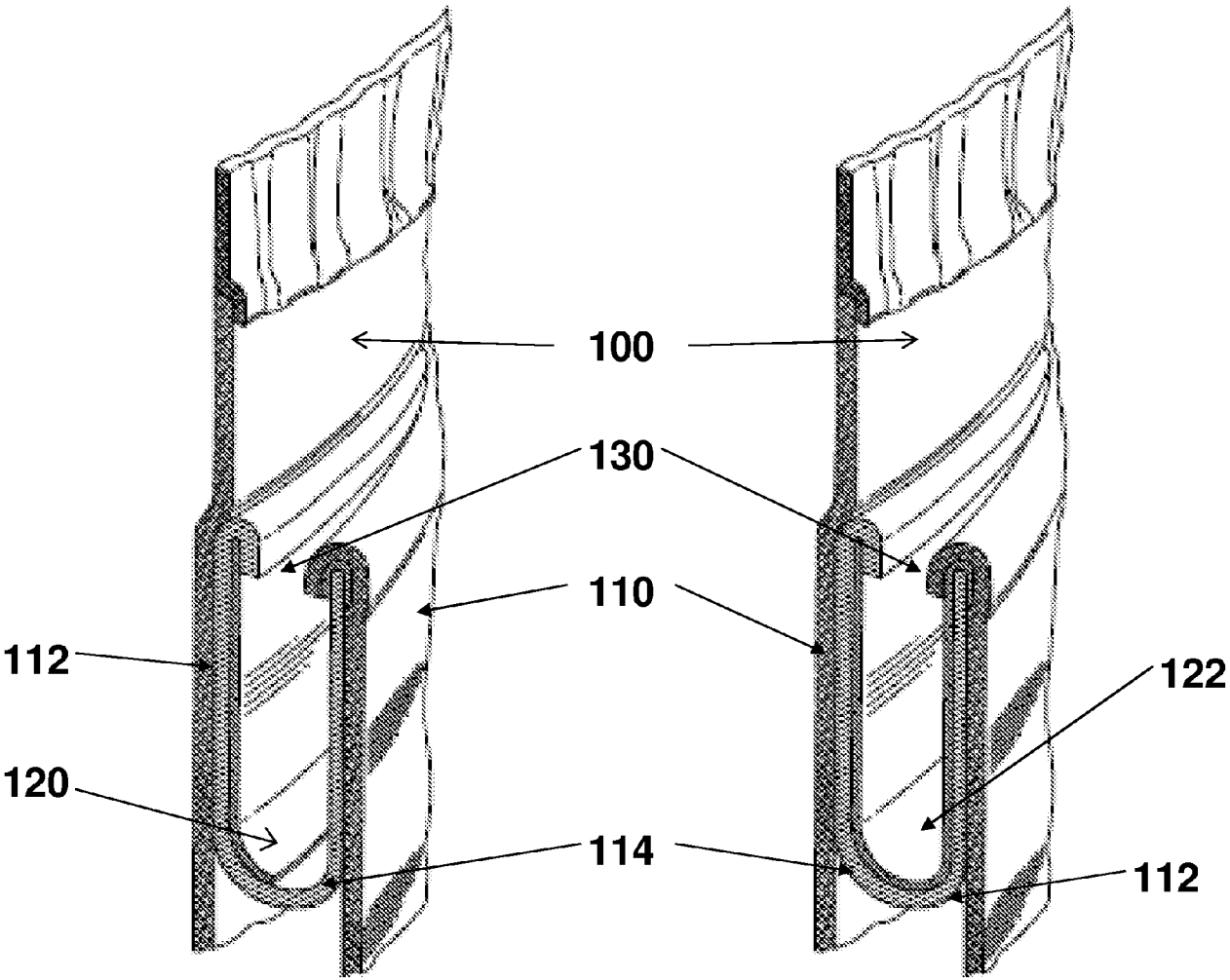
FIG. 1A shows a cutaway perspective view of a pocket with frictionally resistant lining on one side thereof in an embodiment of the disclosed technology and is cut along axis line A-A of FIG. 3A.
FIG. 1B shows a cutaway perspective view of a pocket with frictionally resistant lining on the entire interior portion thereof in an embodiment of the disclosed technology and is cut along axis line B-B of FIG. 3B.
Figure 3B:
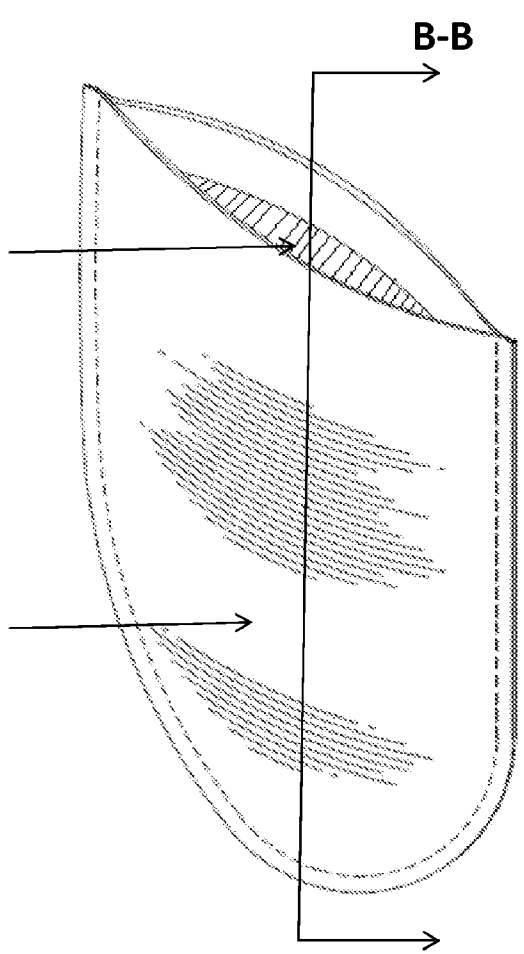
FIG. 3B shows a perspective view of an exterior of a pocket with a lining on an entire interior portion thereof in an embodiment of the disclosed technology.
Figure 3A:
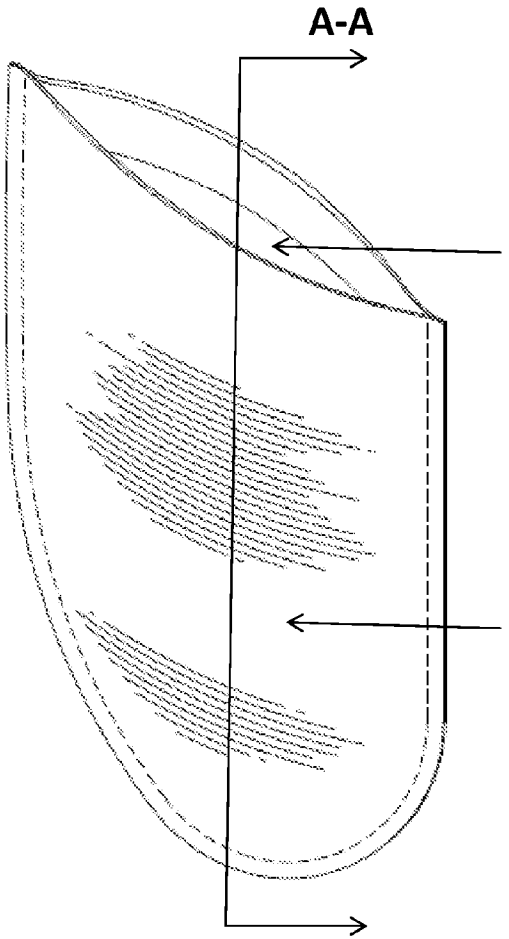
FIG. 3A shows a perspective view of an exterior of a pocket with a lining on one side thereof in an embodiment of the disclosed technology.

FIG. 1A shows a cutaway perspective view of a pocket with frictionally resistant lining on one side thereof in an embodiment of the disclosed technology and is cut along axis line A-A of FIG. 3A. The embodiment of FIG. 1A shows a fabric pocket 110 comprising two opposing fabric elements 112 and 114 which are sewn together to form a pocket. Such a pocket may typically be in long pants, short pants, shirt, or other garment, as is known in the art. The fabric is either a synthetic (e.g., polyester, rayon, etc.) or natural (e.g., cotton, wool, etc.) material, or a combination thereof. The first fabric element and the second fabric element are fixedly attached (e.g., sewn) to each other along a portion of their peripheries, while leaving an aperture (opening) 130 there between at a top side of the fabric elements. The aperture opens into the interior space of the fabric pocket 110 and is large enough to allow for items to pass into the fabric pocket. The aperture 130 may be permanently open or semi-permanently closed by use of such items as a button, a zipper, hook-and-loop fasteners, and the like. While the aperture 130 is referred to as being at the "top" of the pocket, this is relative to the pocket itself, and it may actually be on a side or bottom of a pocket, relative to the ground. As such, in embodiments of the disclosed technology, items are held securely in the pocket even when the pocket is "sideways" or "upside down" relative to the ground. The higher frictional resistance, in such embodiments enables an item to remain within the pocket 110 in such circumstances.

Referring still to FIG. 1A, an interior lining or layer 120 is shown covering fabric section 112. Such a lining, in this embodiment, covers part or all of a fabric 112 and may be sewn onto the fabric 112 before being attached to other fabric, such as fabric 114 or a garment on which the pocket resides. The additional fabric liner 120 comprises a substantially higher frictional resistance than the fabric elements 112, 114 of the pocket. Higher frictional resistance is defined as having a coefficient of friction between a material of an object typically placed in a fabric pocket (e.g., plastics, metals, paper, fibers, etc.) and the fabric liner is greater than within 5%, 10%, 15%, or 20% of the coefficient of friction between the respective material and the fabric element. Thus, when an item is placed into the interior space of a pocket, there is less likelihood that it will fall out of the pocket during normal usage. In an embodiment disclosed, the additional fabric liner is made of a synthetic fiber. In further embodiments, the synthetic fiber is produced from a petroleum product and/or is at least partially a natural fiber. Petroleum products, such as polymers and the like designed to decrease friction, such as drawer liners and carpet pads, have been found to be suitable materials to use for the liner 120 of the pockets in embodiments of the disclosed technology.

As shown in FIG. 1A, the additional liner 120 need only cover part of the interior space of the pocket 110 in embodiments of the disclosed technology. This adds friction benefits (keeping items more securely within the pocket) and allows items to slide, as is typical in the art, back and forth over the fabric of the pocket, such as the fabric element 114. Thus, the wearer of a garment with such a pocket may stroke his/her hand against fabric element 114 and freely move the hand in and out of the pocket through the top/upper aperture 130.

FIG. 1B shows a cutaway perspective view of a pocket with frictionally resistant lining on the entire interior portion thereof in an embodiment of the disclosed technology and is cut along axis line B-B of FIG. 3B. Here, the interior (extra) liner 122 extends to cover at least a part of fabric 112 and fabric 114, such as the entire interior portion of the pocket (defined as 90% or greater). In such an embodiment, an item placed therein may be in contact on at least two adjacent sides or two opposing sides (e.g., a right and left side or top and bottom side), or three sides (e.g., a right, left, and bottom, or top, bottom, and left) of the item. In this manner, the liner 122, having a high frictional resistance, holds the item securely in place based on frictional forces and forces of pocket pushing against the item, such as is known with normal use of pockets. In an embodiment, a first and second additional liner 122 is a single additional liner. In further embodiments, the first and second liners are made, partially or entirely, from different materials, that each has a frictional resistance substantially different from that of the fabric elements of the pocket and/or of each other (e.g., greater by 5 or 10% in frictional resistance when measuring friction of an item placed in a pocket and against the fabric).

As shown in FIG. 1A and FIG. 1B, part of the exterior region of the pocket is fixedly attached to a garment in embodiments of the disclosed technology. A garment is procured from a fabric or material for covering a portion of a person or a thing (e.g., a shirt, pants, jacket, carrying bag, and the like). In an embodiment of the disclosed technology, the garment 100 and the fabric pocket have substantially the same frictional resistance to each other, e.g., the pocket is made from the same type of material as the rest of the garment and the interior liner 120 or 122 has a higher frictional resistance. As such, the interior liner 120 and 122 may be retrofitted to an existing garment and sewn into the garment during its production or the production of the pocket 110.

Figures 2A, 2B:
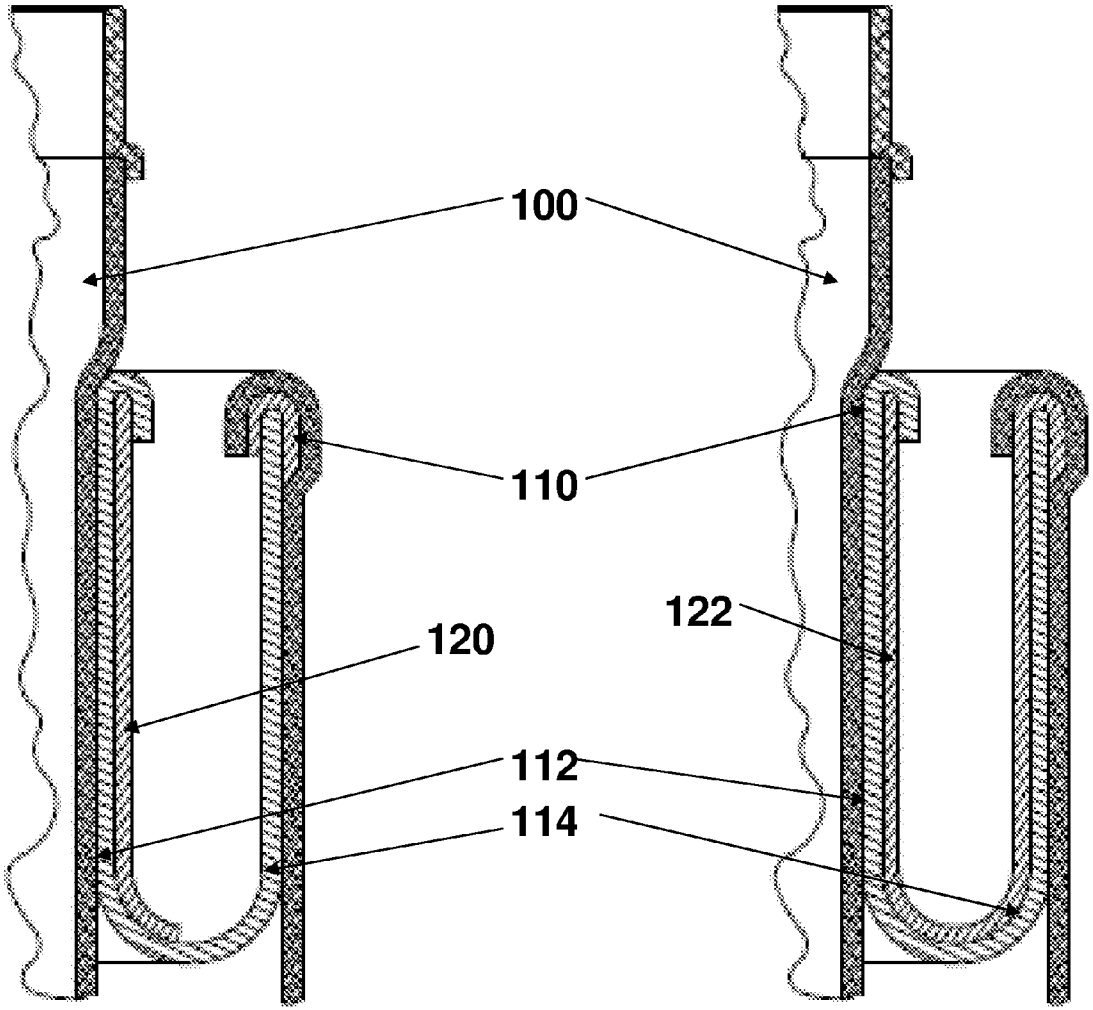
FIG. 2A shows a two-dimensional view of FIG. 1A and is cut along axis line A-A axis of FIG. 3A.
FIG. 2B shows a two-dimensional view of FIG. 1A and is cut along axis line B-B axis of FIG. 3B.

FIG. 2A shows a two-dimensional view of FIG. 1A and is cut along axis line A-A axis of FIG. 3A. FIG. 2B shows a two-dimensional view of FIG. 1A and is cut along axis line B-B axis of FIG. 3B. In these figures, the demarcations between the additional frictional layer 120 or 122, the layers of the pocket 112 and 114, and the layers of the garment 100 are clearly shown. While the pockets 110 shown in FIGS. 2A and 2B are sewn on the outside of the garment 100, such a pocket may open into the garment itself.

FIG. 3A shows a perspective view of an exterior of a pocket with lining on one side thereof in an embodiment of the disclosed technology.

FIG. 3B shows a perspective view of an exterior of a pocket with lining on an entire interior portion thereof in an embodiment of the disclosed technology. Each fabric pocket 110 comprises a first and a second opposing fabric element. The fabric elements are fixedly attached to each other around their peripheries and comprise an aperture 130 along, at least, the top side of the fabric elements. The aperture opens into an interior space of the pocket. In an embodiment of the disclosed technology, as displayed in FIG. 3B, an interior side of the second opposing fabric element 114 comprises a substantially higher frictional resistance than an interior side of a first fabric element. By having a second opposing fabric element 114 comprising a substantially higher frictional resistance, items held in the pocket will have less likelihood of falling out of the fabric pocket 110 during normal usage. In embodiments disclosed, part of the exterior region of a fabric pocket 110, is fixedly attached to a garment 100, as exhibited in FIG. 1A and FIG. 1B. In embodiments disclosed, the garment 100 has substantially the same frictional resistance as the fabric pocket.

Thus, it should be apparent that an object placed within the aperture 130 of either the pocket shown in FIG. 3A or 3B will be held in place more firmly than when using a fabric pocket alone. The higher frictional resistance of the interior (additional) liner on one or both sides of the interior space of the pocket, or a part thereof, such as an upper or lower half of an interior of the pocket, less readily allows an object therein to move around.

In further embodiments of the disclosed technology, as exhibited in FIG. 3B, the second interior side of the fabric element is comprised, entirely or partially, of natural fiber, synthetic fiber, and/or a rubber base. Yet further, an exterior side of the second fabric element 114 comprises substantially identical frictional resistance to the interior side of the first opposing fabric element 112. An example of this, for illustrative purposes, is a fabric pocket 110 where a first fabric element 112 is comprised entirely of natural fibers and the second fabric element 114 is contains the same natural fibers as the first fabric element, as well as a rubber-based coating on its interior side. The rubber-based coating has a higher frictional resistance to items placed in the pocket than the material of the first fabric element, which results in securing items placed in the interior space of the fabric pocket.

Figure 4B:
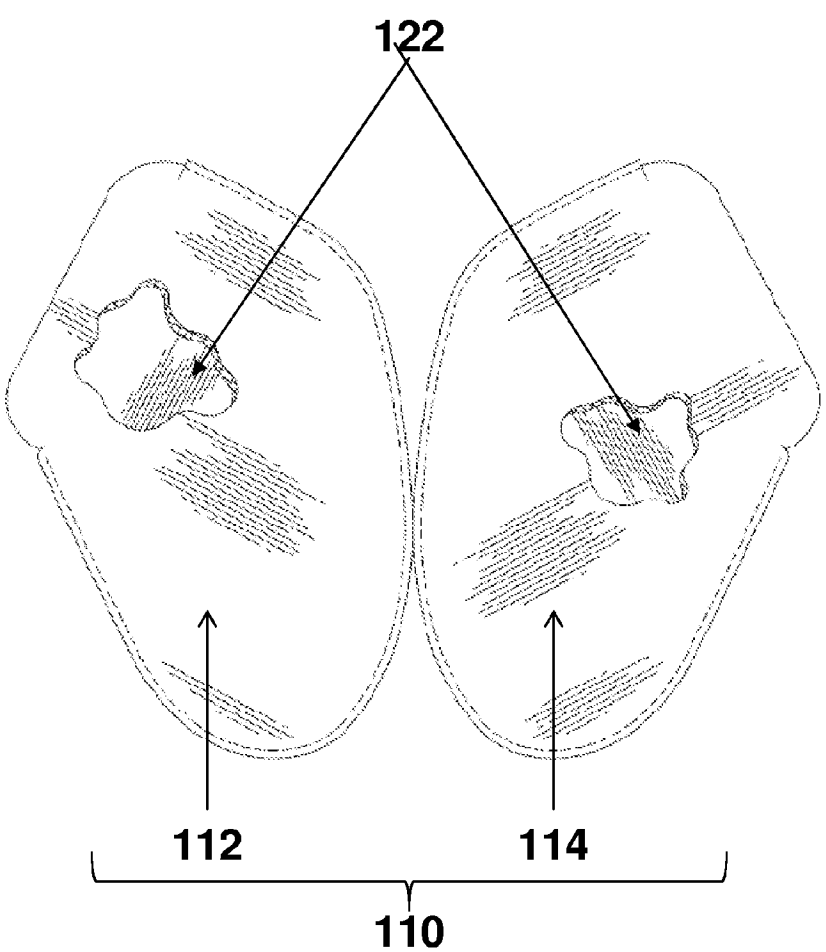
FIG. 4B shows a cutaway view of an exterior of each side of a pocket with a first and second frictional fabric element on one side thereof in an embodiment of the disclosed technology.
Figure 4A:
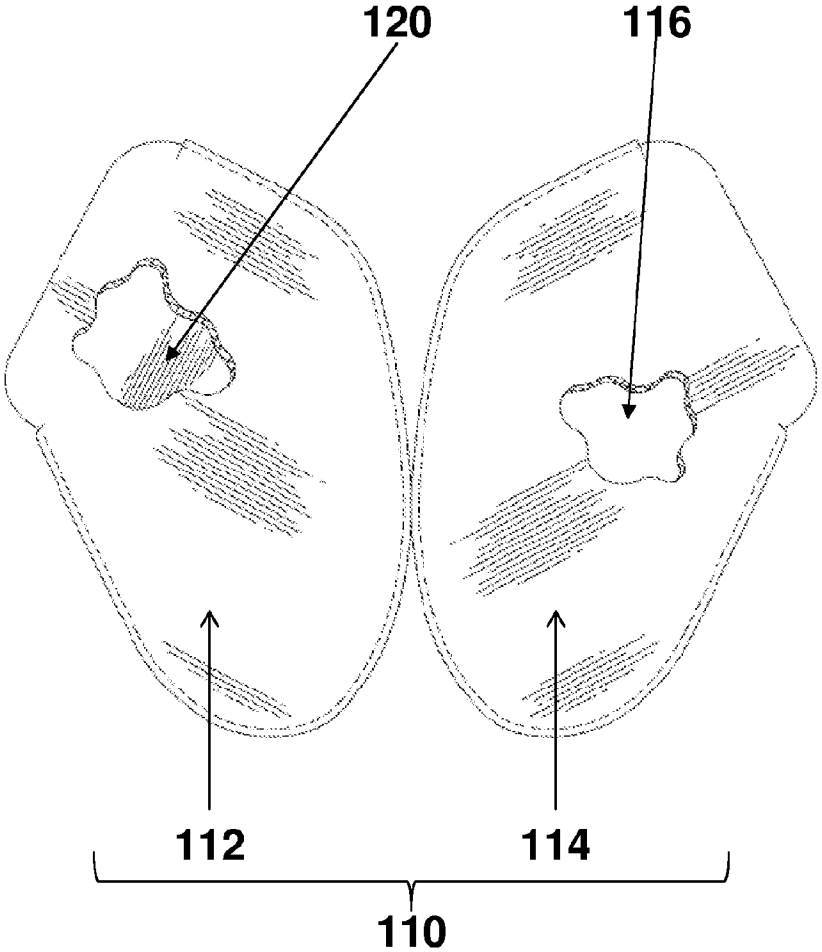
FIG. 4A shows a cutaway view of an exterior of each side of a pocket with a first frictional fabric element on one side thereof in an embodiment of the disclosed technology.

FIG. 4A shows a cutaway view of an exterior of each side of a pocket with a first frictional fabric element on one side thereof in an embodiment of the disclosed technology. FIG. 4B shows a cutaway view of an exterior of each side of a pocket with a first and second frictional fabric element on one side thereof in an embodiment of the disclosed technology. That is, the views of the pockets shown in FIGS. 4A and 4B are a result of splitting the pockets into their exterior elements 112 and 114 and viewing from an exterior side thereof. The fabric pocket 110 comprises a first fabric element 112 that is fixedly attached to a second fabric element 114 as described above. An additional fabric liner 120 or 122 is attached to the interior region of one or more of the fabric elements of a pocket. In FIG. 4A, note in the cutaway section through the fabric liner of the pocket 112 that an additional layer, the frictional interior layer or liner 120 is shown. However, when cutting into layer 114 of the pocket (the opposite side of the pocket), one makes a hole 116 clear through to the other side, similar to what happens with typical pockets when a hole is formed. Thus, the additional frictional layer provides an extra degree of protection from obtaining a hole in a pocket on part or all of one side of a pocket. In FIG. 4B, note that an additional frictional layer or liner 122 is seen in the cutaway portion of both the fabric elements 112 and 114 of the pocket 110.

Figure 5:
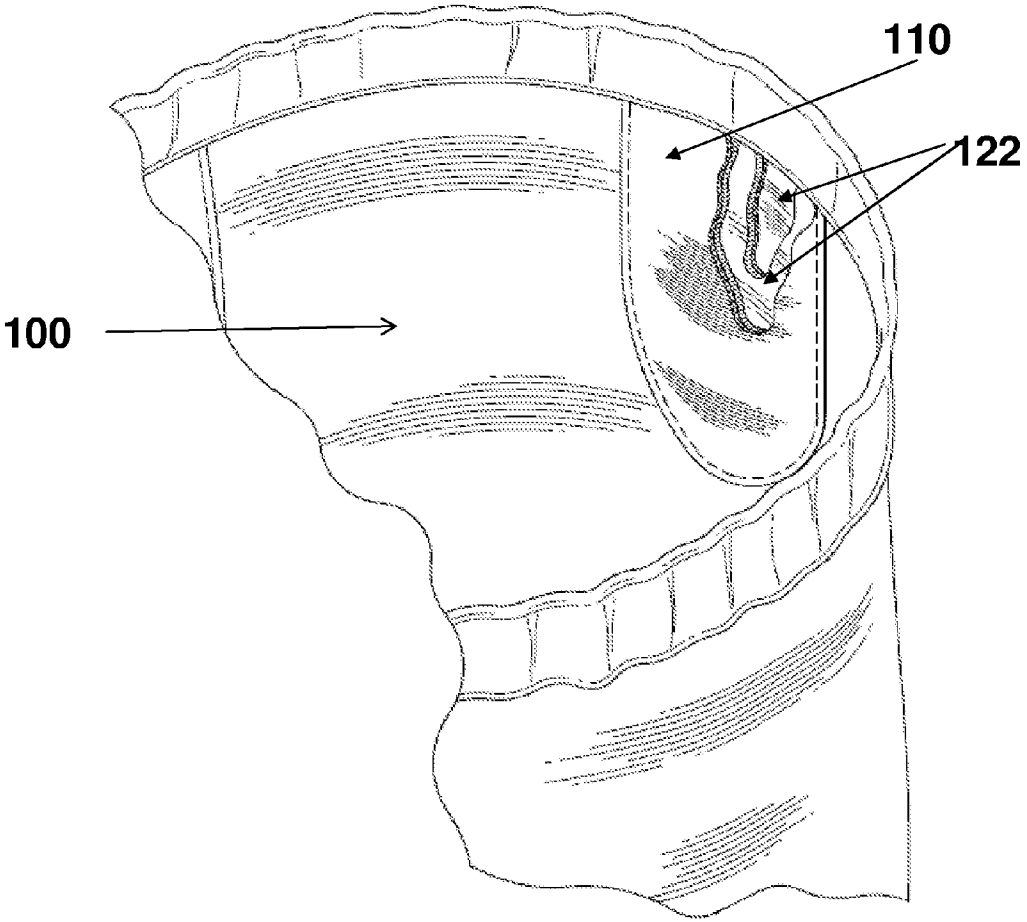
FIG. 5 shows a cutaway view of an interior of a pocket with an extra frictional lining placed into short pants in an embodiment of the disclosed technology.

FIG. 5 shows a cutaway view of an interior of a pocket with an extra frictional lining placed into short pants in an embodiment of the disclosed technology. An embodiment of the disclosed technology comprises a method of wearing a garment, such as garment 100 which may be pants, a shirt, short pants, or the like. The garment is made from a natural fiber and/or synthetic fiber and comprises a fabric pocket 110. At least one side of an interior of a pocket, or an entire interior has substantially higher frictional resistance than an adjacent fabric of the garment to the pocket and/or the exterior of the fabric pocket, as defined above. In the method of the disclosed technology, a user places an object (not shown) in the pocket that touches at least one side of the interior of the pocket, the interior having a higher frictional resistance layer. Thus, the position of the object becomes secured or less likely to move as a result of the increased friction, but is nevertheless accessible. That is, the aperture 130 of a pocket need not be closed, sealed, or otherwise changed. In the embodiment shown in FIG. 5, higher frictional resistance layer or liner 122 is seen in this cutaway view twice, e.g., once on each side of the pocket. Thus, an object placed there-between through an aperture of a pocket is held on each side by the liner 122, especially when the pocket is compressed, e.g., when a leg of a wearer presses against a garment, thus holding the object in place between an exterior layer of the garment and the leg. Due to the higher frictional resistance of the additional liner, an object placed therein is much less likely to fall out, even when the aperture faces towards the ground (e.g., gravitational forces pull the object towards the aperture and out of the pocket).

Figure 6:
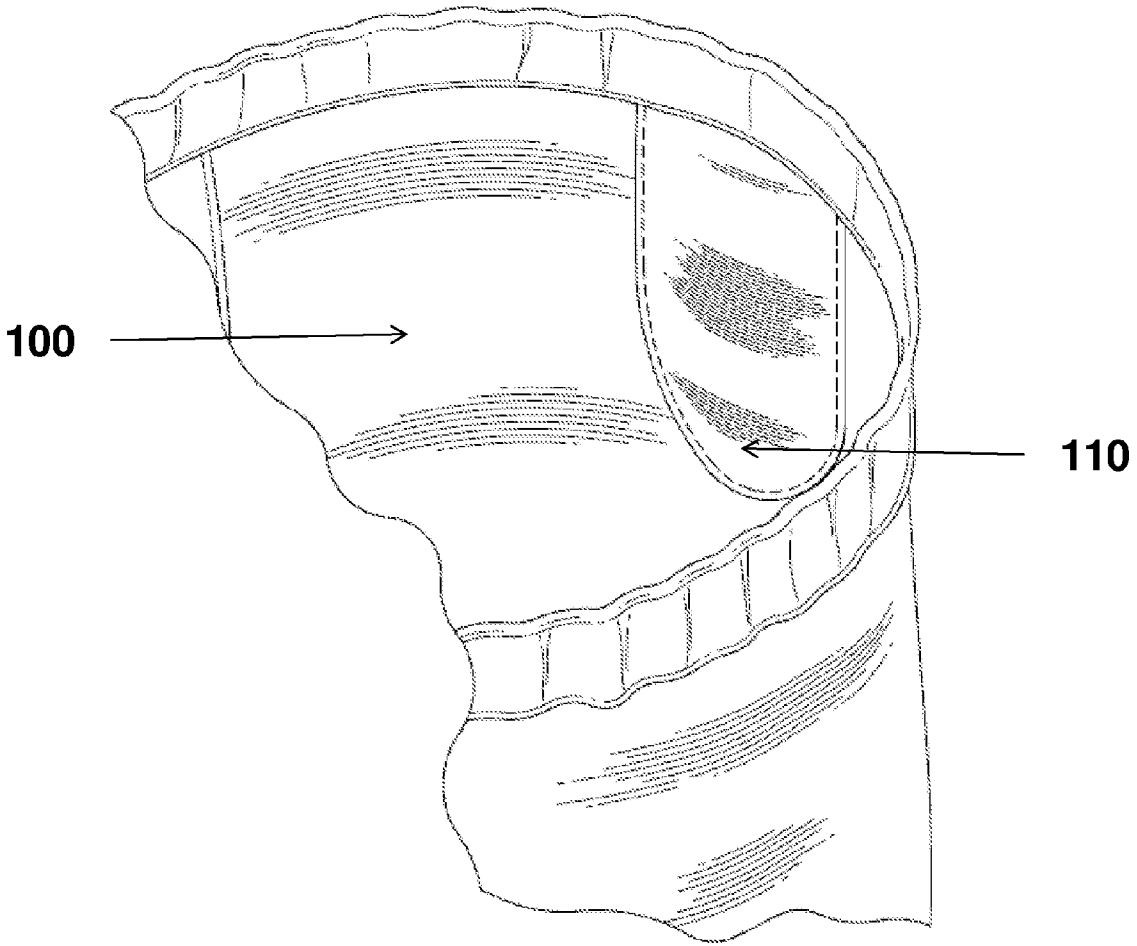
FIG. 6 shows a perspective view of an interior of a pocket with an extra frictional lining placed into short pants in an embodiment of the disclosed technology.

FIG. 6 shows a perspective view of an interior of a pocket with an extra frictional lining placed into short pants in an embodiment of the disclosed technology. The garment 100 and an external side of the fabric pocket 110 are procured from material of substantially equal frictional resistance, so a wearer of the garment 100 feels an equal amount of comfort from the texture of the garment 100 as from the texture of the fabric pocket. However, the interior lining (not shown) adds greater resistance to movement of objects placed therein.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the invention.

I claim:

1. A fabric pocket comprising:

two opposing fabric elements fixedly attached to each other at their peripheries and comprising an aperture there between, said aperture opening into an interior space of said pocket;

an additional fabric liner fixedly attached along an entire surface thereof within said interior space of said pocket to an entirety of at least a first said fabric element such that all of said first fabric element is covered by said additional fabric liner, said additional fabric liner comprising a coefficient of friction that is at least 20% greater than that of said fabric elements.

2. The fabric pocket of claim 1, further comprising a second additional fabric liner fixedly attached within said interior space of said pocket to a second said fabric element such that all of said second fabric element is covered by said additional fabric liner, said additional fabric liner comprising a substantially higher frictional resistance than said fabric elements.

3. The fabric pocket of claim 1, wherein at least part of an exterior region of said pocket is fixedly attached to a garment.

4. The fabric pocket of claim 3, wherein said garment has substantially the same frictional resistance as said fabric pocket.

5. The fabric pocket of claim 1, wherein said additional fabric liner is a synthetic fiber.

6. The fabric pocket of claim 5, wherein said additional fabric liner is produced from a petroleum product.

7. The fabric pocket of claim 5, wherein said fabric elements are an at least partially natural fiber.

8. A fabric pocket comprising:

A first and second opposing fabric element fixedly attached to each other at their peripheries and comprising an unobstructed aperture there between at at least a portion of a top side of said fabric elements, said aperture opening into an interior space of said pocket;

wherein at least an interior side of said second opposing fabric element comprises a coefficient of friction that is at least 20% greater than that of an at least interior side of said first fabric element.

9. The fabric pocket of claim 8, wherein an exterior side of said second fabric element comprises substantially identical frictional resistance to that of said interior side of said first opposing fabric element.

10. The fabric pocket of claim 8, wherein at least part of an exterior region of said pocket is fixedly attached to a garment.

11. The fabric pocket of claim 10, wherein said garment has substantially the same frictional resistance as said fabric pocket.

12. The fabric pocket of claim 8, wherein said second interior side of said fabric element is a synthetic fiber.

13. The fabric pocket of claim 8, wherein said second interior side of said fabric element is rubber-based.

14. The fabric pocket of claim 8, wherein said first fabric element is an at least partially natural fiber.

15. A method of storing an object comprising the steps of:

wearing a garment, said garment comprising a pocket having two opposing interior sides wherein at least one said side of said interior of said pocket comprises a substantially higher frictional resistance than an at least adjacent fabric of the garment to said pocket;

placing an object in said pocket touching said at least one side of said interior of said pocket, wherein said object and said one side of said interior of said pocket have a coefficient of friction that is at least 20% greater than that of said object and said adjacent fabric; and releasing said object.

16. The method of claim 15, wherein an entire said interior of said pocket comprises a substantially higher frictional resistance than said fabric of said garment adjacent to said pocket.

17. The method of claim 15, wherein an entire said interior of said pocket comprises a substantially higher frictional resistance than an exterior of said pocket.

18. The fabric pocket of claim 15, wherein said at least one side of said interior of said pocket is formed from a synthetic fiber.

19. The fabric pocket of claim 15 wherein said at least one side of said interior of said pocket is formed from a petroleum product.

20. The fabric pocket of claim 18, wherein said fabric of said garment is at least partially produced from a natural fiber.

* * * * *